US005340334A

United States Patent [19]

Nguyen

[11] Patent Number: 5,340,334

[45] Date of Patent: Aug. 23, 1994

[54] FILTERED ELECTRICAL CONNECTOR

[75] Inventor: Hung T. Nguyen, Harrisburg, Pa.

[73] Assignee: The Whitaker Corporation, Wilmington, Del.

[21] Appl. No.: 93,832

[22] Filed: Jul. 19, 1993

[51] Int. Cl.[5] ..... H01R 13/66

[52] U.S. Cl. ..... 439/620; 439/108

[58] Field of Search ..... 439/108, 608, 609, 620

[56] References Cited

U.S. PATENT DOCUMENTS

| | | | |
|---|---|---|---|
| 3,985,413 | 10/1976 | Evans | 339/17 LM |
| 4,356,532 | 10/1982 | Donaher et al. | 361/393 |
| 4,371,226 | 2/1983 | Brancaleone | 339/147 R |
| 4,376,922 | 3/1983 | Muzslay | 333/182 |
| 4,500,159 | 2/1985 | Briones et al. | 339/147 R |
| 4,519,665 | 5/1985 | Althouse et al. | 339/147 R |
| 4,580,866 | 4/1986 | Hagner | 339/147 R |
| 4,582,385 | 4/1986 | Couper et al. | 339/147 R |
| 4,600,256 | 7/1986 | Anttila | 339/17 M |
| 4,600,262 | 7/1986 | Nieman et al. | 339/147 R |
| 4,606,598 | 8/1986 | Drzymkowski et al. | 339/147 R |
| 4,660,907 | 4/1987 | Belter | 339/14 R |
| 4,690,479 | 9/1987 | Hollyday et al. | 439/97 |
| 4,695,115 | 9/1987 | Talend | 439/76 |
| 4,707,048 | 11/1987 | Giliha et al. | 439/620 |
| 4,707,049 | 11/1987 | Gliha | 439/620 |
| 4,726,638 | 2/1988 | Farrar et al. | 439/620 R |
| 4,726,790 | 2/1988 | Hadjis | 439/620 |
| 4,729,752 | 3/1988 | Dawson, Jr. et al. | 439/620 |
| 4,772,221 | 9/1988 | Kozlof | 439/549 |
| 4,772,224 | 9/1988 | Talend | 439/607 |
| 4,772,225 | 9/1988 | Ulery | 439/620 |
| 4,781,624 | 11/1988 | Shepherd | 439/620 |
| 4,789,360 | 12/1988 | Paul et al. | 439/620 |
| 4,797,120 | 1/1989 | Ulery | 439/578 |
| 4,804,332 | 2/1989 | Pire | 439/620 |
| 4,820,170 | 4/1989 | Redmond et al. | 439/66 |
| 4,846,732 | 7/1989 | Meelhuysen | 439/620 |
| 4,880,397 | 11/1989 | Dawson, Jr. et al. | 439/620 |
| 4,884,982 | 12/1989 | Fleming et al. | 439/620 |
| 4,929,196 | 5/1990 | Ponn et al. | 439/620 |
| 4,930,200 | 6/1990 | Brush, Jr. et al. | 29/25.42 |
| 4,934,960 | 6/1990 | Capp et al. | 439/620 |
| 4,950,185 | 8/1990 | Boutros | 439/620 |
| 4,954,794 | 9/1990 | Nieman et al. | 333/182 |
| 4,992,061 | 2/1991 | Brush, Jr. et al. | 439/620 |
| 5,018,989 | 5/1991 | Black et al. | 439/620 |
| 5,057,041 | 10/1991 | Yu et al. | 439/620 |
| 5,082,457 | 1/1992 | Wollscheidt et al. | 439/620 |
| 5,087,212 | 2/1992 | Hanami | 439/620 |
| 5,094,628 | 3/1992 | Kano | 439/620 |
| 5,102,354 | 4/1992 | Crane et al. | 439/620 |
| 5,112,253 | 5/1992 | Swift | 439/620 |
| 5,141,454 | 8/1992 | Garrett et al. | 439/620 |
| 5,141,455 | 8/1992 | Ponn | 439/620 |
| 5,147,224 | 9/1992 | Tan et al. | 439/620 |
| 5,151,054 | 9/1992 | Briones et al. | 439/620 |
| 5,152,699 | 10/1992 | Pfeifer | 439/620 |
| 5,158,482 | 10/1992 | Tan et al. | 439/620 |
| 5,213,522 | 5/1993 | Kojima | 439/620 |
| 5,221,215 | 6/1993 | Tan et al. | 439/620 |
| 5,221,216 | 6/1993 | Gabany et al. | 439/620 |
| 5,246,389 | 9/1993 | Briones | 439/620 |

OTHER PUBLICATIONS

AMPLIFLEX Surface Mount Connectors.

*Primary Examiner*—Eugene F. Desmond

*Attorney, Agent, or Firm*—Katherine A. Nelson

[57] ABSTRACT

A filtered connector includes a housing member having a plurality of electrical terminal members disposed in respective terminal receiving passageways, a like plurality of electrical components disposed in component receiving passageways, a ground means including a plate-like portioned disposed adjacent a forward face of the housing member, a rear plate disposed adjacent the rearward face of the housing member, and resilient conductive means to bias the electrical components and complete an electrical path from the terminal members to a respective component to ground. The components are of the type having a pair of spaced external electrodes. The component receiving passageways are essentially parallel to and spaced from respective associated terminal receiving passageways. The ground and rear plates define forward and rearward stop surfaces respectively for the component receiving passageways. The rear plate further includes conductive paths that extend between respective component receiving passageways to respective terminal receiving bores and into electrical engagement with the terminals disposed therein. The resilient conductive means is under compression in each component receiving passageway adjacent one of the plates, electrically connecting one of the component electrodes to the one plate and biasing the component against the other plate and the other electrode into electrical engagement therewith.

11 Claims, 5 Drawing Sheets

FILTERED ELECTRICAL CONNECTOR

FIELD OF THE INVENTION

This invention relates to electrical connectors, and more particularly to filtered electrical connectors for providing protection against electromagnetic interference.

BACKGROUND OF THE INVENTION

Electrical circuitry often must be protected from disruptions caused by electromagnetic interference (EMI) entering the system.

Frequently today's electronic circuitry requires the use of high density, multiple contact electrical connectors. There are many applications in which it is desirable to provide a connector with a filtering capability, for example, to suppress EMI. To retain the convenience and flexibility of the connector, however, it is desirable that the filtering capability be incorporated into connectors in a manner that will permit full interchangability between the filtered connectors and their unfiltered counterparts. In particular, any filtered connector should also in many instances retain substantially the same dimensions as the unfiltered version and should have the same contact arrangement so that either can be connected to an appropriate mating connector.

One method of achieving filtering capability is to incorporate a circuit board having a plurality of electrical components mounted thereto. The components include multilayer ceramic capacitors or transient suppression diodes or the like, typically of the type having a pair of spaced external electrodes, which are soldered or adhered with conductive adhesives to circuit paths on the board. Accordingly, the solder or otherwise adhered interconnections are subject to stresses caused by movement of the board whether from thermal expansion or contraction or when used in an environment subject to constant vibration. U.S. Pat. No. 4,729,752 discloses a board having transient suppression diodes thereon. Other patents having components mounted on boards include U.S. Pat. Nos. 4,992,061 and 4,600,256. U.S. Pat. Nos. 5,151,054 and 5,152,699 disclose the use of ground springs for holding chip capacitors in electrical engagement with terminals in connectors.

SUMMARY OF THE INVENTION

Accordingly, the present invention is directed to a filtered connector that alleviates problems associated with the prior art. The filtered connector includes a housing member having a plurality of electrical terminal members disposed in respective terminal receiving passageways, a like plurality of electrical components disposed in component receiving passageways, a ground means including a plate-like portioned disposed adjacent a forward face of the housing member, a rear plate disposed adjacent the rearward face of the housing member, and resilient conductive means to bias the electrical components and complete an electrical path from the terminal members to a respective component to ground. The terminal receiving and the component receiving passageways extend between forward and rearward faces of the dielectric housing member with each of the component receiving passageways being associated with one of the terminal receiving passageways and spaced therefrom. The terminal members include a forward contact section extending through terminal receiving apertures of the ground portion and rearward contact sections which extend through corresponding apertures in the rear plate. The ground portion apertures have a diameter greater than those of the terminal receiving passageways such that when the connector is assembled the edges of the ground apertures are spaced from the forward contact sections. The ground plate defines a forward stop surface and the rear plate defines a rearward stop surface for each of the component receiving passageways. The rear plate further includes conductive paths on the forward face thereof that extend between respective component receiving passageways to respective terminal receiving bores and are in electrical engagement with the terminal members disposed therein. The component receiving passageways include a first portion adjacent either the ground portion or the rear plate, the first portion being dimensioned to receive a resilient conductive means therein and a second portion dimensioned to receive an electrical component of the type having a pair of spaced electrodes. In the assembled connector, one of the component electrodes is in engagement with the resilient conductive means and the other of the component electrodes is engaged against one of the forward or rearward stop surfaces on the ground plate and rear plate respectively with the resilient conductive member being engaged with the other of the stop surfaces, thereby completing an electrical path from the terminal member to the component to ground.

In the preferred embodiment, the housing member further includes an elongate channel intersecting several of the component receiving passageways at the forward end thereof. The resilient conductive means is disposed in the channel and assures electrical connection between the ground plate and the electrode at the forward end of the component. The resilient conductive member is preferably an elastomeric connector such as disclosed in U.S. Pat. No. 3,985,413. The product known as an AMPLIFLEX connector is available from AMP Incorporated. The AMPLIFLEX connector is comprised of a thin polyamide film having a plurality of individual parallel circuits disposed thereon. The film is wrapped around a soft non-conducting silicone rubber core. When the AMPLIFLEX connector is compressed between flat surfaces, the plated circuit lines interconnect circuit pads on each surface. Other elastomeric or similar connectors, such as the connectors disclosed in U.S. Pat. No. 4,820,170 may also be used. It will be recognized that when the resilient conductive member is placed between the component and ground, the resilient means may also be a continuously conductive member such as a canted coiled spring. Alternatively, the housing member may include a channel along its rear face in which the resilient conductive member is disposed. The individual circuits on the AMPLIFLEX Connector or similar connector, however, ensure that the contact pads on the rear plate member are not commoned by the resilient conductive member.

In the preferred embodiment the ground means includes a separate ground plate and a metal shroud member that are attached to the housing member, the shroud member defining a mating face for complementary electrical connector. In a further alternative embodiment, the housing member includes forwardly extending shroud portions defining a mating face and the ground means is a stamped and formed member which is secured within the mating cavity and has a plate portion extending over the forward face of the housing member.

It is an object of the invention to provide a filtered connector that is cost effective to manufacture and assemble.

It is also an object of the invention to provide a filtered connector that will lend itself to automated assembly.

It is an object of the invention to provide a filtered electrical connector that is reliable in environments subject to vibration.

It is an object of the invention to maximize insertion loss performance of chip capacitors in a connector.

It is another object of the invention to provide an electrical connector that eliminates the need to solder electrical components to a circuit board.

It is a further object of the invention to provide a filtered connector wherein the electrical components are protected by the housing.

Embodiments of the present invention will now be described in detail with reference to the accompanying drawings.

DESCRIPTION OF THE DRAWINGS

Figure 1:
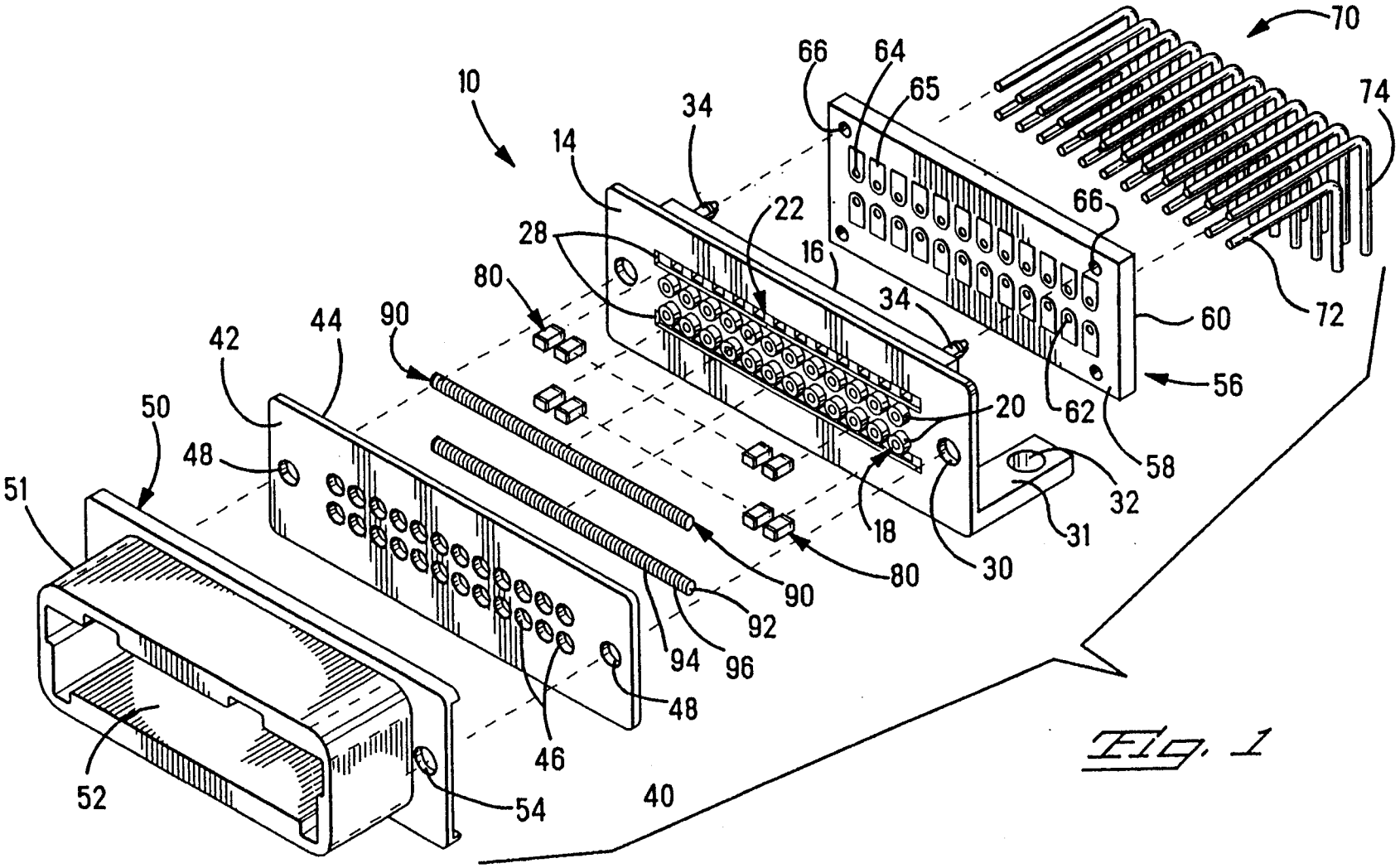
FIG. 1 is an exploded perspective view of the connector of the present invention.
Figure 2:
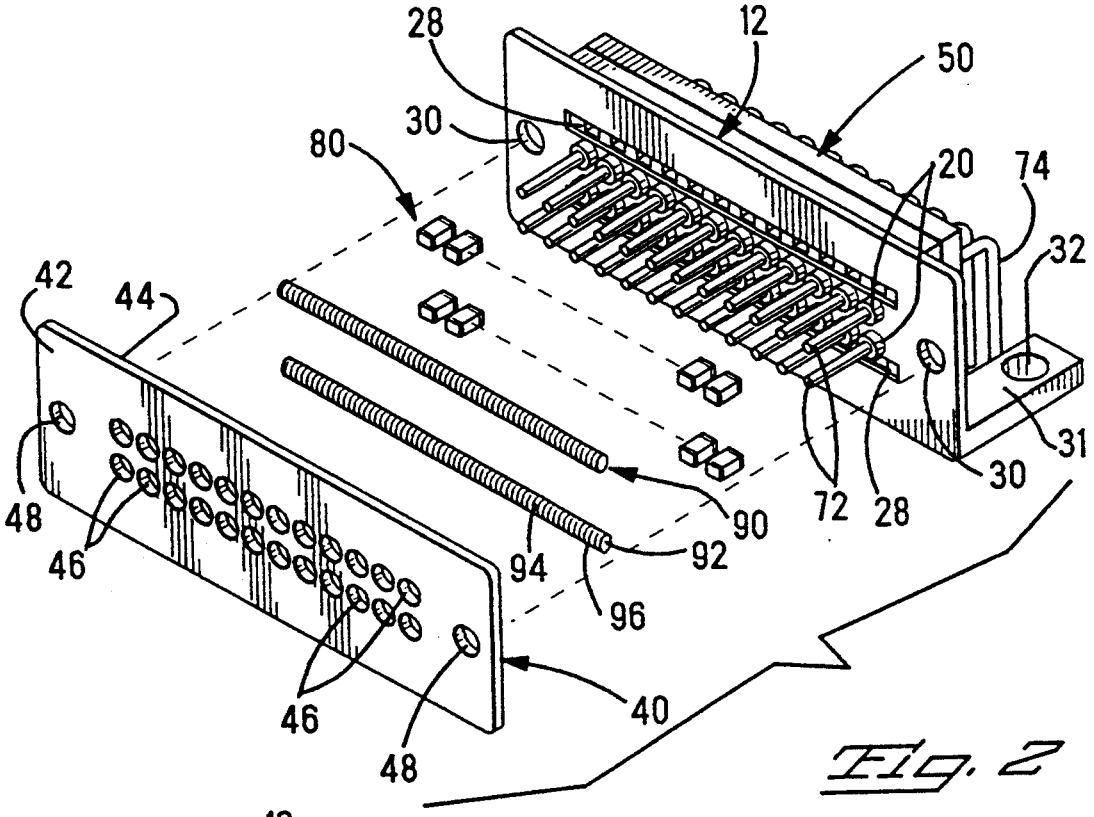
FIG. 2 is a partially assembled view of the connector of FIG. 1 with the electrical components, resilient conductive means and ground plate exploded therefrom.
Figure 3:
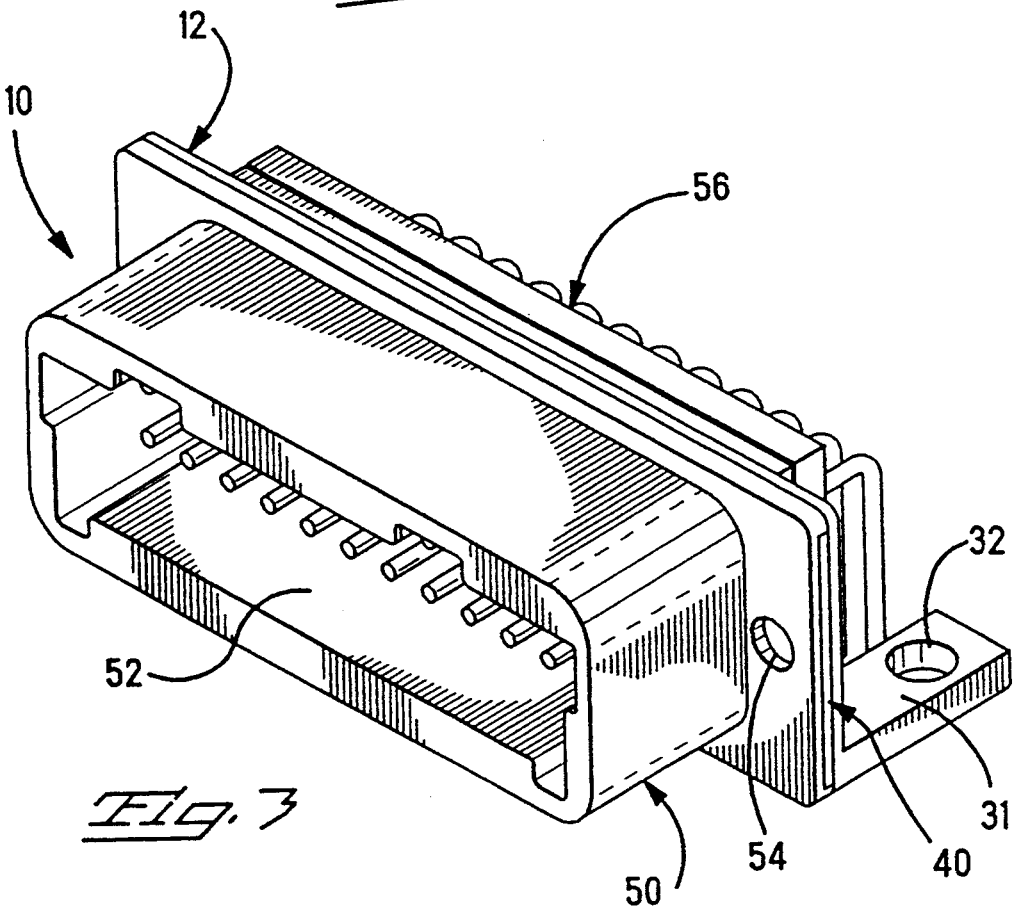
FIG. 3 is the assembled connector of FIG. 1.

Referring now to FIGS. 1, 2, 3 and 4, the filtered connector 10 of the present invention includes dielectric housing member 12, ground means including a ground plate 40 and a ground shield member 50, a rear plate 56, a plurality of terminal members 70, a plurality of electrical components 80 and resilient conductive means 90. For purposes of illustrating the invention, the connector is shown as a plug and the terminal members 70 are shown as pin terminals. It is to be understood that the invention is suitable for use with a variety of connectors and electrical terminals having other contact sections, such as, for example, sockets.

Figure 4:
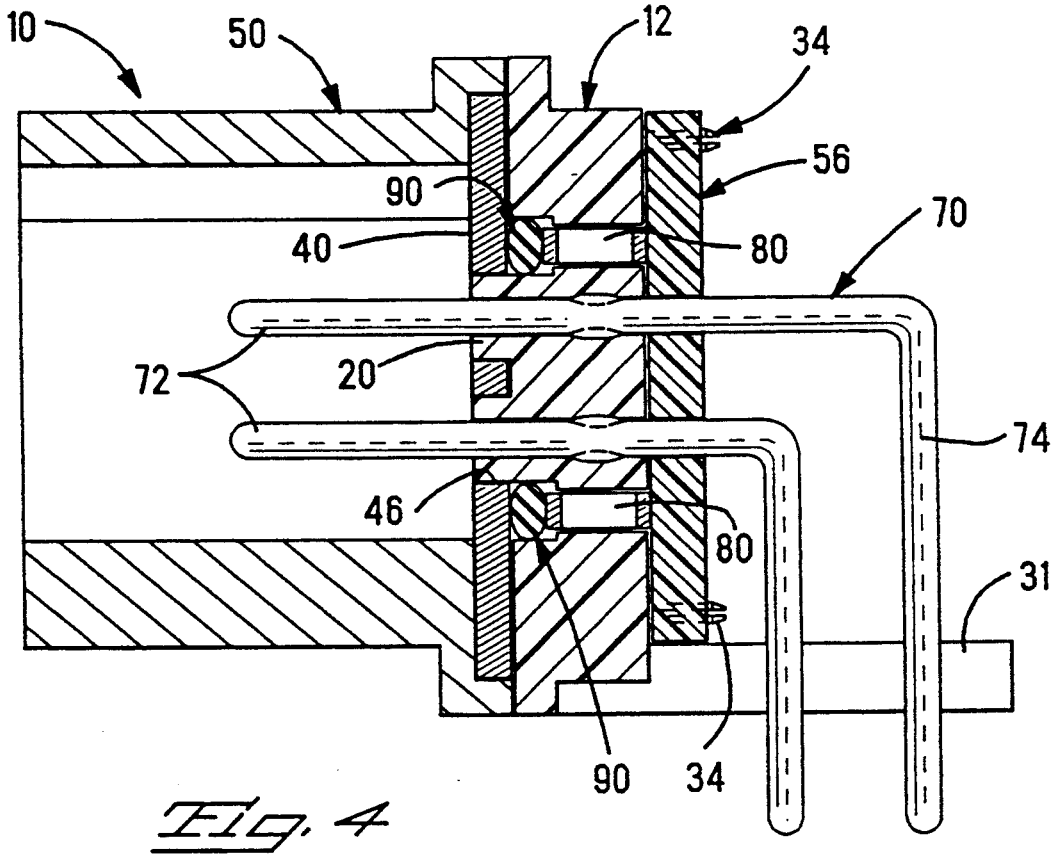
FIG. 4 is the cross-sectional view of the connector of FIG. 3.
Figure 5:
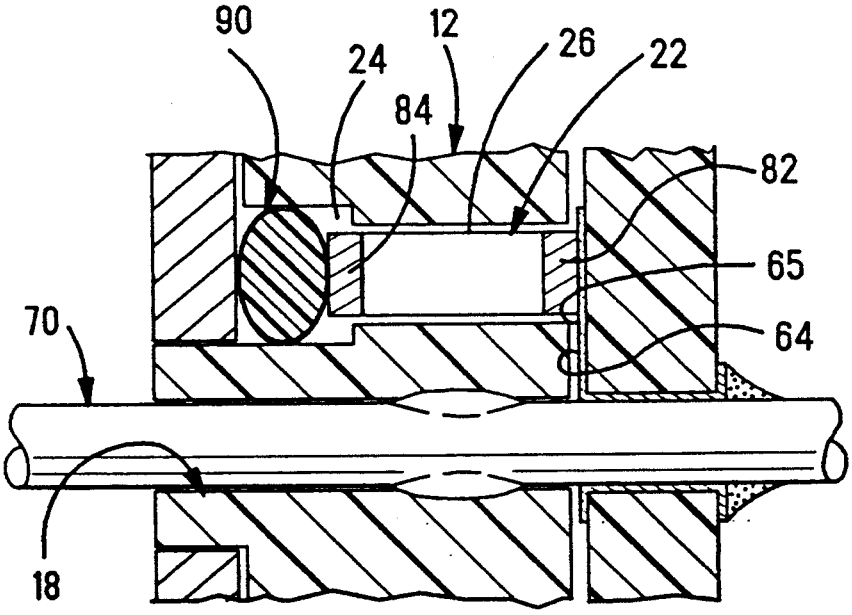
FIG. 5 is an enlarged fragmentary connector portion of FIG. 4 illustrating the electrical path of one component between the ground component and the terminal member.

The dielectric housing member 12 has a forward face 14, a rearward face 16, a plurality of terminal receiving passageways 18 extending therebetween and a plurality of component receiving passageways 22 also extending between the forward and rearward faces 14, 16, as is best seen in FIG. 4 and in enlarged view in FIG. 5. In the preferred embodiment, the housing member 12 further includes a plurality of protrusions 20 that extend forwardly from the forward face 14 and surround the openings of the respective terminal receiving passageways 18. The component receiving passageways 22, as best seen in FIG. 5, include an enlarged portion 24 adapted to receive a resilient conductive member therein and a component receiving portion 26. In the embodiment shown in FIGS. 1 through 5, the enlarged portion 24 is at the forward face 14 of the housing member 12. In the alternative embodiment 110, shown in FIG. 6, the enlarged portion is at the rearward face 116 of housing member 112. Housing member 12 in the preferred embodiment 10 as shown in FIG. 1, further includes a channel 28, which extends along the forward face of the housing member 12 intersecting the forward ends of several of the component receiving passageways 22. Connector 10, as shown in FIG. 1, includes two such channels 28, one located above and one below the two rows of protrusions 20. One component receiving passageway 22 is associated with each one of the terminal receiving passageways 18 and is spaced therefrom, such that the terminal receiving passageways 18 and component receiving passageways 22 are essentially parallel to one another. Housing member 12 further includes plurality of apertures 30 for receiving securing means (not shown) used in assembling the connector 10 together. Housing member 12 includes mounting leg 31 having aperture 32 therein for mounting the connector 10 to a circuit board (not shown). Mounting means 34 for securing the rear plate 56 to housing member 12 extend rearwardly from rearward face 16 thereof. Housing member 12 may be made from a variety of materials, such as polyesters, polyphthalamides, and other suitable engineering resins, as known in the art. The ground means includes ground plate 40 and ground shield member 50. Ground plate 40 includes forward and rearward faces 42, 44 respectively, and a plurality of terminal receiving apertures 46 extending therebetween. Ground plate 40 also includes apertures 48 used in assembling connector 10. Ground plate 42 defines forward stop surfaces for the component receiving passageways 22. The ground shield member 50 includes a forward shroud portion 51 defining a mating cavity 52 for a complementary connector (not shown) and apertures 54 for receiving securing means therethrough. Ground plate 40 and ground shield member 50 may be made from copper alloys such as brass or bronze and are generally tin plated, as known in the art.

The rear plate member 56 includes forward and rearward faces 58, 60 respectively, and a plurality of terminal receiving bores 62 extending therebetween and aligned with respective ones of the terminal receiving passageways 18 of housing member 12. The forward face 58 of plate 56 defines a rear stop surface for each of the component receiving passageways 22 and further includes conductive paths 64 extending from respective component receiving passageways 22 to respective terminal receiving bores 62. Rear plate 56 may be made from a dielectric material or may be made from an inductive material, such as a ferrite block, which are commercially available.

Terminal men, hers 70 include a forward section 72 and a rearward section 74. When the terminal members 70 are disposed within the respective terminal receiving passageways 18 of housing member 12, the forward sections 72 of the terminal members 70 extend through the terminal receiving apertures 46 of the ground plate 40 and into the cavity 52 of the ground shield 50 as shown in FIG. 4. The second contacts section 74 extend rearwardly from the rear plate 56 as shown in FIG. 4. If a right angled connector is desired, terminals sections 74 may be bent either before or after assembling the connector.

Electrical components 80 are of the type having exposed electrodes 82, 84 at opposite ends thereof as best seen in FIGS. 4 and 5. The components may be multilayered ceramic capacitors, diodes or other chip-like components as known in the art. The chip-like components are of dimensions of a few hundredths of an inch, such as, for example, 0.08×0.05×0.04 inches.

The resilient means 90 is preferably an elastomeric connector of the type disclosed in U.S. Pat. No. 3,985,413. This product known as an AMPLIFLEX connector is available from AMP Incorporated. The AMPLIFLEX connector is comprised of a thin polyamide film 94 having a plurality of individual parallel circuit paths 96 disposed thereon. The film is wrapped around a soft non-conducting silicone rubber core 92, as shown in FIG. 1. When the AMPLIFLEX connector is compressed between flat surfaces, the plated circuit lines interconnect circuit pads on each surface. Other elastomeric or similar connectors, such as the connectors disclosed in U.S. Pat. No. 4,820,170 may also be used. It will be recognized that when a common resilient conductive member is placed between the components and ground, the resilient means need not have individual circuits but may be a continuously conductive member such as a canted coiled spring. If a common resilient means is disposed in a channel intersecting a plurality of component receiving passageways along the rear face 16 of housing member 12, the individual circuits of the AMPLIFLEX Connector or similar connector ensure that the contact pads 65 on the rear plate member 56 are not commoned by the resilient conductive member 90. It is to be understood that individual elastomeric members may also be used in assembling the connector, but this greatly increases the number of parts and the amount of time and labor to assemble the connector.

The assembly and structure of connector 10 is best understood by referring to FIGS. 4 and 5. Terminal members 70 are inserted through respective terminal receiving bores 62 in the rear plate 56 and into the respective terminal receiving passageways 18 of housing member 12. The forward face 58 of the rear plate 56 lies adjacent to the rearward face 16 of housing 12. As seen in enlarged portion in FIG. 5, the conductive path 64 extends as a plated through-hole 62. Conductive path 64 extends to rear stop surface 65 for the component receiving passageway 22 in housing member 12. The electrical components 80 are then mounted into the corresponding component receiving passageways 22 such that first electrode 82 lies adjacent to and in electrical contact with the conductive path on the stop surface 65. The second electrode 84 extends into the enlarged passageway portion 24. A length of the resilient conductive member 90 is then disposed within the respective cavity 28 as shown in FIG. 1 such that the conductors 96 on the surface of the resilient means extend between the second component electrodes 84 and are exposed for interconnection to the ground plate 40. The ground plate 40 is then disposed over the forward face 14 of the housing with the terminal forward section 72 extending through the terminal receiving apertures 46. As can be seen in FIGS. 4, the diameter of the terminal receiving apertures 46 of ground plate 40 are dimensioned to receive the protrusions 20 therein, thereby isolating the ground plate from the terminal members. The shield member 50 is then secured to the connector. As can be seen in FIGS. 4 and 5, the resilient conductive member 90 is placed under compression upon securing the ground plate to housing 12. The resilient conductive means electrically engages the ground plate 40 and second component electrode 82 and biases the component 80 such that the first electrode 82 is biased into electrical engagement with the conductive pad 64 thereby completing an electrical path from each respective terminal member 70 to the associated component 80 to ground. If desired, the terminal members 70 may also be soldered to the rear plate in addition to securing the rear plate 56 to the housing member 12. It is to be understood that since the ground plate cocoons all of the second electrodes 84, the resilient means 90 may also be a continuously conductive member such as a canted coiled spring or the like.

It should be noted that the configuration of the component receiving passageways 22 permits the components 80 to be loaded from either the forward face 14 or the rearward face 16 of housing member 12. It is primarily the configuration of the selected terminal members 70 and whether they are to be loaded from the forward or rearward face or alternatively insert molded into the housing member 12 that will determine the order in which the elements are assembled.

Figure 6:
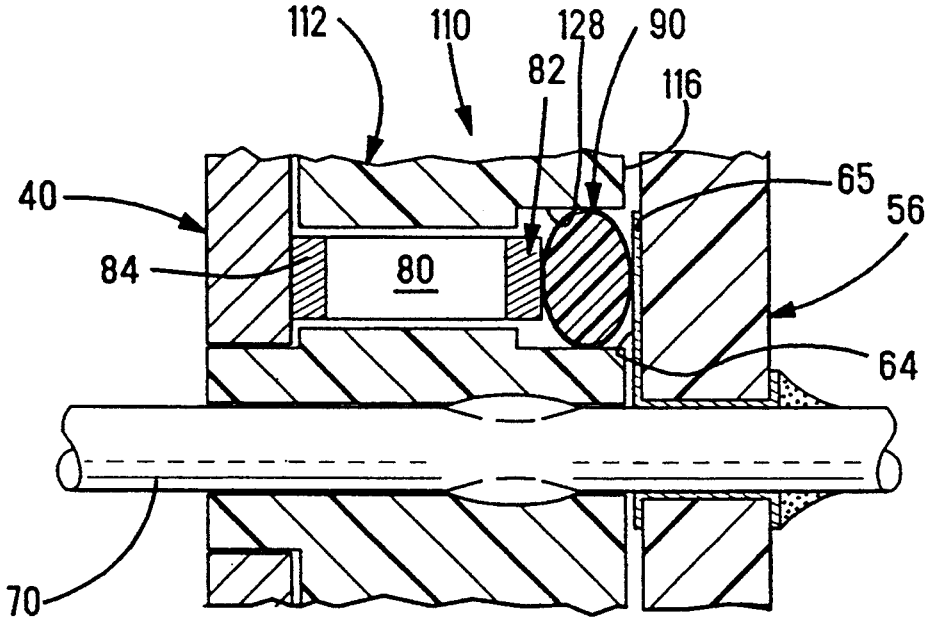
FIG. 6 is a view similar to that of FIG. 5 showing an alternative embodiment of the connector.

FIG. 6 gives an enlarged fragmentary portion of an alternative embodiment 110 of the present invention. In this embodiment, the resilient means channel 128 is formed on the rearward face 116 of connector housing 112 and the resilient means 90 is disposed in the connector adjacent to the rear plate 56 such that the individual circuit paths 96 on the resilient means provide isolated electrical paths between the corresponding contact pad 64 and the first component electrode 82. In this embodiment, the resilient means 90 biases the component 80 against the rear plate.

Figure 7:
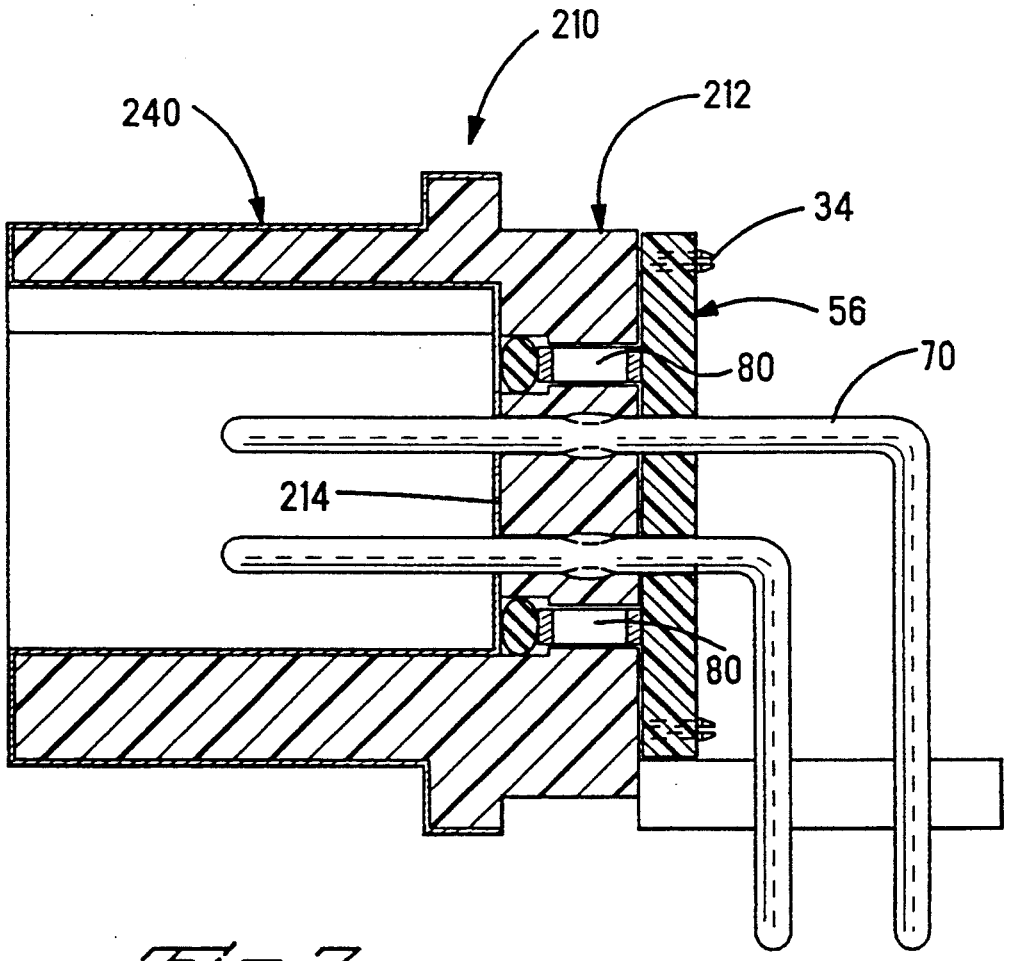
FIG. 7 is a cross-sectional view of a further alternative embodiment.

FIG. 7 shows a cross-sectional view of a further alternative embodiment 210 wherein the housing 212 includes a forward shroud section and the ground means 240 is a stamped and formed member which is inserted into the mating cavity of the connector and across the forward face 214 of the housing 212.

Figure 8:
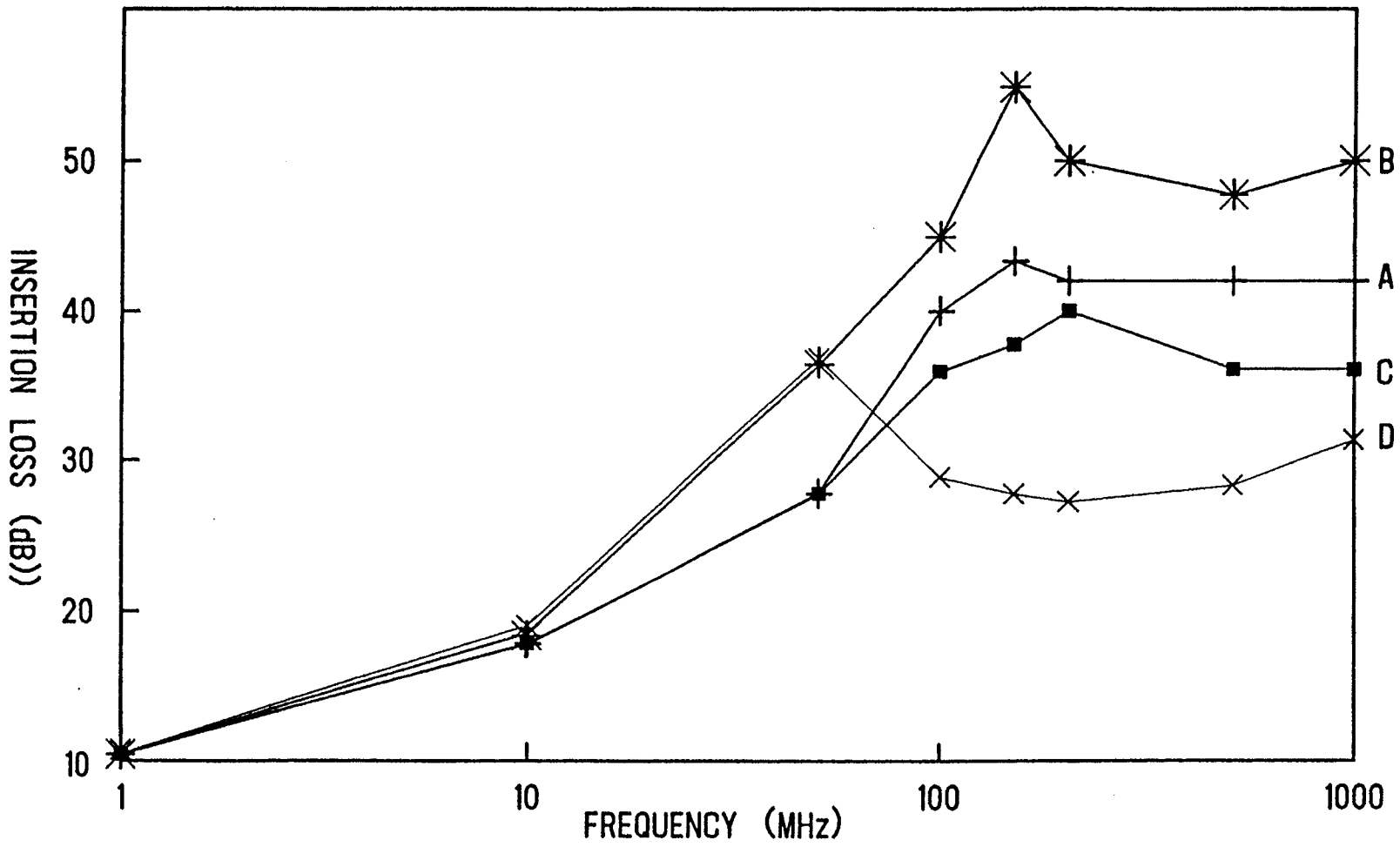
FIG. 8 is a graph comparing the insertion loss of various filtered devices as frequency increases.

The insertion loss for filtered connectors was measured in accordance to Military Standard No. 220A, "Method of Insertion-Loss Measurement," to evaluate the electrical performance for various filtered connector designs. A comparison of the insertion loss versus frequency of same capacitance, 1500 picofarads, for filtered devices made in accordance with the invention and other devices of the prior art is shown in the graph of FIG. 8. The insertion loss curve for a device made in accordance with the invention and having a rear plate made from a dielectric substrate is labeled A and shows that this embodiment of the invention has an insertion loss of 38dB at 100 megahertz and 40dB at and above 200 megahertz. The curve labeled B shows the insertion loss for a device made in accordance with the invention using a rear plate made of ferrite. Curve B shows that this embodiment of the invention has an insertion loss of 46dB at 100 megahertz. The curve labeled C shows the insertion loss of a connector having capacitor chips mounted on a circuit board within the connector housing. The curve labeled D shows an estimated insertion loss for a system having an unfiltered connector mounted to a circuit board at one location and capacitive chips mounted to the board at another location. The graph shows that devices made in accordance with the invention give better insertion loss that devices of the prior art.

The present invention provides a filtered connector that eliminates the need for soldering electrical components such as capacitors, transient suppression diodes, or the like to a circuit board. The electrical components furthermore are protected within the housing. The resilient conductive member assures electrical connection between grounds through the component and to the terminal.

It is believed that the parallel placement of the component in the housing reduces the ground path impedance and minimizes resonance effects, thereby giving superior performance over the connectors in the prior art. The parallel placement of the component in the housing such that the component is not in direct contact with the terminal allows the invention to be used with a wide variety of electrical terminals since the terminals do not need to be adapted to engage one of the flat ends of the electrical components. The structure of the connector lends itself to automated assembly. A further advantage of the invention is that the electrical component is resiliently held within the housing without the need for soldering.

It is thought that the filtered connector of the present invention and many of its attendant advantages will be understood from the foregoing description. It is apparent that various changes may be made in the form, construction, and arrangement of the parts thereof without departing from the spirit or scope of the invention or sacrificing all of its material advantages.

I claim:

1. A filtered connector comprising:

a dielectric housing member having a plurality of terminal receiving passageways extending between a forward face and a rearward face thereof, said housing member further including a like plurality of component receiving passageways extending between said forward and rearward faces, each of said component receiving passageways being associated with a respective one of said terminal receiving passageways and being spaced therefrom;

a plurality of terminal members, each disposed in a respective terminal receiving passageway of said housing member, said terminal members having a forward contact section and a rearward contact section;

ground means including a plate-like portion disposed adjacent said forward face of said housing member, said plate-like portion including a plurality of terminal receiving apertures extending therethrough aligned with respective ones of said terminal receiving passageways of said housing member and through which extend respective forward contact sections of said terminal members, said ground portion apertures having a diameter greater than the diameter of said respective passageway such that edges of said ground portion apertures are spaced from said forward contact sections, said ground portion further defining a forward stop surface for each of said component receiving passageways;

a rear plate disposed adjacent said rearward face of said housing member having a plurality of terminal receiving bores extending therethrough aligned with respective ones of said terminal receiving passageways of said housing member and having respective ones of said second contact section of said terminal members extending therethrough, a forward face of said plate defining a rear stop surface for each of said component receiving passageways and including conductive paths extending from respective said component receiving passageways to respective said terminal receiving bores and in electrical engagement with respective said terminal members disposed therein;

resilient conductive means disposed in a portion of each said component receiving passageways adjacent one of said ground portion and said rear plate at a respective one of said conductive paths, said means being under compression; and a plurality of electrical components of the type having a pair of spaced external electrodes, one of each said components being disposed in a respective said component receiving passageway with one of said pair of electrodes being in engagement with said resilient conductive means;

whereby upon assembly said compressed resilient conductive means for each said component electrically engages said one of said ground portion and a said rear plate conductive path and a respective component electrode and biases said component against the other of said ground portion and a said rear plate conductive path for the other said component electrode to be biased into electrical engagement with said other of said ground portion and a said rear plate conductive path thereby completing an electrical path from each said terminal member to a said component to ground.

2. The filtered connector of claim 1 wherein a common said resilient conductive means is disposed in a channel along said forward face of said housing member.

3. The filtered connector of claim 2 wherein said channel intersects several said component receiving passageways and said common resilient conductive means engages said ones of said electrodes of several said components simultaneously.

4. The filtered connector of claim 1 wherein said resilient conductive means comprises a thin flexible film wrapped around a non-conducting elastomeric core, said film having a plurality of individual essentially parallel lines of circuitry disposed on the outer surface thereof.

5. A filtered connector comprising:

a dielectric housing member having a plurality of terminal receiving passageways extending between a forward face and a rearward face thereof, said housing member further including a like plurality of component receiving passageways extending between said forward and rearward faces, each of said component receiving passageways being associated with a respective one of said terminal receiving passageways and being spaced therefrom;

a plurality of terminal members, each disposed in a respective terminal receiving passageway of said housing member, said terminal members having a forward contact section and a rearward contact section;

ground means including a plate-like portion disposed adjacent said forward face of said housing member, said plate-like portion including a plurality of terminal receiving apertures extending therethrough aligned with respective ones of said terminal receiving passageways of said housing member and through which extend respective forward contact sections of said terminal members, said ground portion apertures having a diameter greater than the diameter of said respective passageway such that edges of said ground portion apertures are spaced from said forward contact sections, said ground portion further defining a forward stop surface for each of said component receiving passageways;

a rear plate disposed adjacent said rearward face of said housing member having a plurality of terminal receiving bores extending therethrough aligned with respective ones of said terminal receiving passageways of said housing member and having respective ones of said second contact section of said terminal members extending therethrough, a forward face of said plate defining a rear stop surface for each of said component receiving passageways and including conductive paths extending from respective said component receiving passageways to respective said terminal receiving bores and in electrical engagement with respective said terminal members disposed therein;

resilient conductive means disposed in a forward portion of each said component receiving passageways, said means being under compression; and a plurality of electrical components of the type having a pair of spaced external electrodes, one of each said components being disposed in a respective said component receiving passageway with one of said pair of electrodes being in engagement with said resilient conductive means;

whereby upon assembly said compressed resilient conductive means electrically engages said ground portion and respective ones of said component electrodes and biases said components against said rear plate for the others of said component electrodes to be biased into electrical engagement with respective said conductive paths thereby completing an electrical path from said terminal member to said components to ground.

6. The filtered connector of claim 5 wherein a common said resilient conductive means engages said ones of said electrodes of several said components simultaneously.

7. The filtered connector of claim 6 wherein a said common resilient conductive means is disposed in a channel along said forward face of said housing member intersecting several said component receiving passageways.

8. The filtered connector of claim 5 wherein said resilient conductive means comprises a thin flexible film wrapped around a non-conducting elastomeric core, said film having a plurality of individual essentially parallel lines of circuitry disposed on the outer surface thereof.

9. A filtered connector comprising:

a dielectric housing member having a plurality of terminal receiving passageways extending between a forward face and a rearward face thereof, said housing member further including a like plurality of component receiving passageways extending between said forward and rearward faces, each of said component receiving passageways being associated with a respective one of said terminal receiving passageways and being spaced therefrom;

a plurality of terminal members, each disposed in a respective terminal receiving passageway of said housing member, said terminal members having a forward contact section and a rearward contact section;

ground means including a plate-like portion disposed adjacent said forward face of said housing member, said plate-like portion including a plurality of terminal receiving apertures extending therethrough aligned with respective ones of said terminal receiving passageways of said housing member and through which extend respective forward contact sections of said terminal members, said ground portion apertures having a diameter greater than the diameter of said respective passageway such that edges of said ground portion apertures are spaced from said forward contact sections, said ground portion further defining a forward stop surface for each of said component receiving passageways;

a rear plate disposed adjacent said rearward face of said housing member having a plurality of terminal receiving bores extending therethrough aligned with respective ones of said terminal receiving passageways of said housing member and having respective ones of said second contact section of said terminal members extending therethrough, a forward face of said plate defining a rear stop surface for each of said component receiving passageways and including conductive paths extending from respective said component receiving passageways to respective said terminal receiving bores and in electrical engagement with respective said terminal members disposed therein;

resilient conductive means disposed in a rearward portion of each said component receiving passageway, said means being under compression; and a plurality of electrical components of the type having a pair of spaced external electrodes, one of each said components being disposed in a respective said component receiving passageway with one of said pair of electrodes being in engagement with said resilient conductive means;

whereby upon assembly said compressed resilient conductive means for each said component electrically engages said rear plate at a respective one of said conductive paths and a respective component electrode and biases said component against said ground portion for the other said component electrode to be biased into electrical engagement with said ground portion thereby completing an electrical path from each said terminal member to a said component to ground.

10. The filtered connector of claim 9 wherein said resilient conductive means comprises a thin flexible film wrapped around a non-conducting elastomeric core, said film having a plurality of individual essentially parallel lines of circuitry disposed on the outer surface thereof and wherein a common said resilient conductive means engages said ones of said electrodes of several said components simultaneously.

11. The filtered connector of claim 10 wherein said common resilient conductive means is disposed in a channel along said rearward face of said housing member intersecting several said component receiving passageways.

* * * * *